United States Patent [19]

Althof, Jr.

[11] Patent Number: 5,036,745

[45] Date of Patent: Aug. 6, 1991

[54] DEFAULTLESS MUSICAL KEYBOARDS FOR WOODWIND STYLED ELECTRONIC MUSICAL INSTRUMENTS

[76] Inventor: Theodore H. Althof, Jr., 504 E. 9th Ave., Tarentum, Pa. 15084

[21] Appl. No.: 267,093

[22] Filed: Nov. 4, 1988

[51] Int. Cl.[5] ..... G10H 1/22

[52] U.S. Cl. ..... 84/656; 84/DIG. 2; 84/DIG. 20; 307/231; 328/137; 328/154; 340/825.51; 341/27

[58] Field of Search ..... 84/1.01, 1.03–1.17, 84/DIG. 2, DIG. 20, 653, 656, 678, 684, 742; 341/22, 24, 25–27, 29, 30; 307/231; 328/137, 154; 340/825.5, 825.51

[56] References Cited

U.S. PATENT DOCUMENTS

| | | | |
|---|---|---|---|
| 2,301,184 | 11/1942 | Arnold . | |
| 3,439,106 | 4/1969 | Goodale . | |
| 3,767,833 | 10/1973 | Noble et al. . | |
| 4,038,895 | 8/1977 | Clement et al. . | |
| 4,342,244 | 8/1982 | Perkins . | |
| 4,381,689 | 5/1983 | Oya | 84/1.01 |
| 4,430,917 | 2/1984 | Pepper | 84/1.01 |
| 4,470,332 | 9/1984 | Aoki | 84/1.03 |
| 4,489,636 | 12/1984 | Aoki et al. | 84/1.01 |
| 4,527,456 | 7/1985 | Perkins et al. | 84/1.04 |
| 4,700,604 | 10/1987 | Morikawa et al. | 84/1.03 |
| 4,747,332 | 5/1988 | Uchiyama et al. | 84/DIG. 2 |

*Primary Examiner*—Stanley J. Witkowski

[57] ABSTRACT

A decoder assigns key values according to a system of mathematical weight values in terms of whole and semitone intervals of the musical scale, each key contributing its assigned value to the sum when depressed. Any interval along the scale can be reached by any combination of depressed keys that sum to that interval amount from the open "zero reference" position. The result is a woodwind-style keyboard that is perfectly regular and which has no default or unusable fingering combinations.

15 Claims, 3 Drawing Sheets

DEFAULTLESS MUSICAL KEYBOARDS FOR WOODWIND STYLED ELECTRONIC MUSICAL INSTRUMENTS

TECHNICAL FIELD

This invention relates to the subject of electronic keyboards for musical instruments, such as flutes and woodwinds.

Disclosure of the Invention

All the modern woodwinds can trace their ancestry to the simple tone-hole flutes of prehistoric times. Such flutes are comprised of some sort of oscillation producing vortex or reed arrangement, powered by the human breath and coupled to an enclosed column of air. This air column "loads" the mechanical oscillation and is primarily responsible for the resonant frequency of the system. By varying the length of this column, the frequency of oscillation is correspondingly varied. The longer the column, the lower the frequency. The discovery that a single tube containing the air column can be made to produce a plurality of frequencies by introducing holes along its length which are then selectively closed and opened by covering them with the fingers or—later a mechanical pad-valve contrivance—was made millennia ago.

In such an arrangement, however, the air column ends at the open hole nearest the oscillation generating vortex. Thus, nature imposes a strict straight-line order to the fingering system of such instruments; holes must be progressively closed from the "top" down to play a descending scale and opened in exact reverse order to play that same scale from the bottom up. In centuries of mechanical evolution, this system has been enhanced, refined, and—in the west—standardized, but this natural logic of straight order hole closures remains intrinsic to the family of woodwinds. It is one of the few musical logic systems to come to us from nature herself.

With the advent of electrics and electronics, however, the possibility arose to emulate this "natural" keyboard system using electrical oscillators to produce waves and electrical switches to replace the "holes". And most recently with the huge and rapid progress in digital electronics technologies, the straight-order logic of the old flutes can be left utterly behind. The "holes" can now be programmed to behave in just about any manner or logical order the designer might conceive.

For any such redesign of the fingering system to be of use and value, chaos—though nearly possible—is the wrong choice. One begins with a replication of the old natural system of flutes—the use of electronics being practical here for interfacing and a good number of other reasons than the keyboard logic system.

MODES OF CARRYING OUT THE INVENTION

I. Basics

Figure 1:
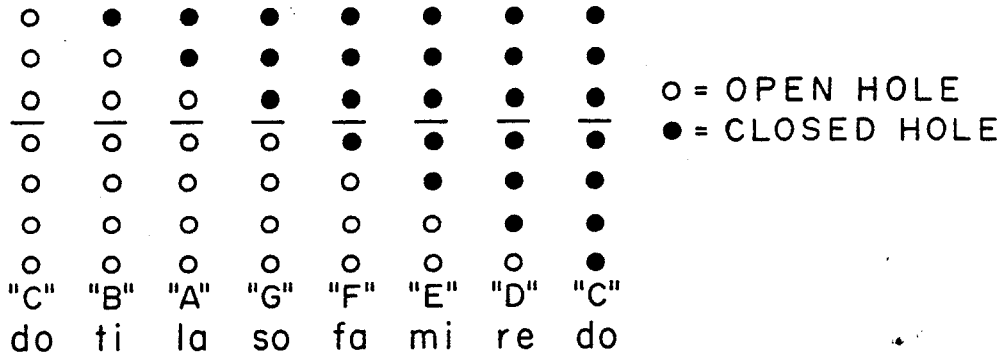
FIG. 1 represents a simplified woodwind keyboard.

With reference to the figures, FIG. 1 represents a simplified woodwind keyboard capable of playing a one-octave major scale with seven holes (or switches). As represented, there is but one fingering pattern for playing each of 8 different tones.

Figure 2:
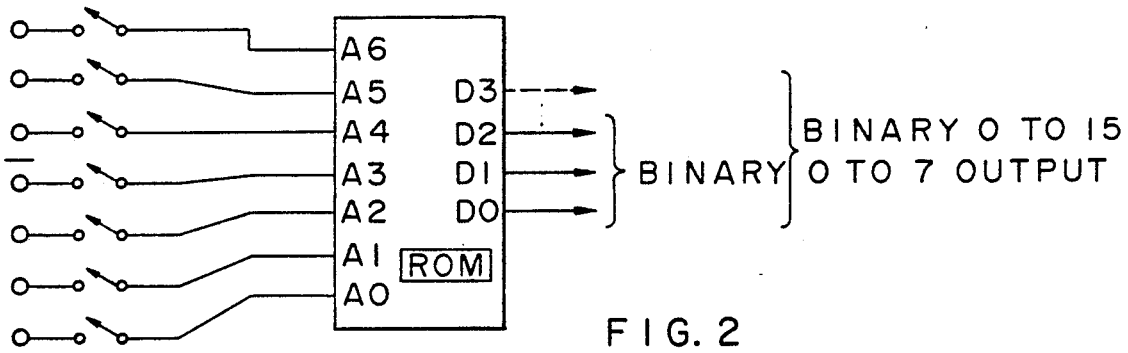
FIG. 2 is an keyboard and associated electronic components.

In FIG. 2, the tone hole are replaced with momentary switches connected to the address inputs of a decoding chip such as a ROM or EPROM, programmed to establish the keyboard fingering system desired. Let us say we elect to program the chip in FIG. 2 with the straight order system of FIG. 1. This is done easily, not nearly exhausting the possible number of binary combinations available. This inventor initially tried such a system and discovered the following difficulty: those patterns which were specifically programmed performed as expected, but a great number of non-programmed, non-rational address combinations had not been provided for. When non-programmed patterns were input, the chip output defaulted to 000—or open—position. These occurred far more often than anticipated while playing this keyboard, both by human mistakes and also due to the fact that human reaction is generally far slower than digital switching times. When switches were not closed in perfect simultaneity, default outputs occurred, which had the effect of interjecting a lot of extra "C's" into the music, which proved utterly objectionable and unacceptable, even when contact debounce and other response-slowing circuitry was added.

The problem then became to somehow program all input possibilities. Seven key/switches represent seven binary bits. This means that no less than 128 different fingering patterns are possible—even in this simplified representation. Making the scale fully chromatic with all 12 semitones and the octave was only a partial solution, now dividing the 128 patterns among 13 notes. But what to do with all those combinations? How to structure them into any kind of rational order? I finally came up with a musically "algebraic" or "interval summing" system based upon the standard piano keyboard scale.

Figure 3:
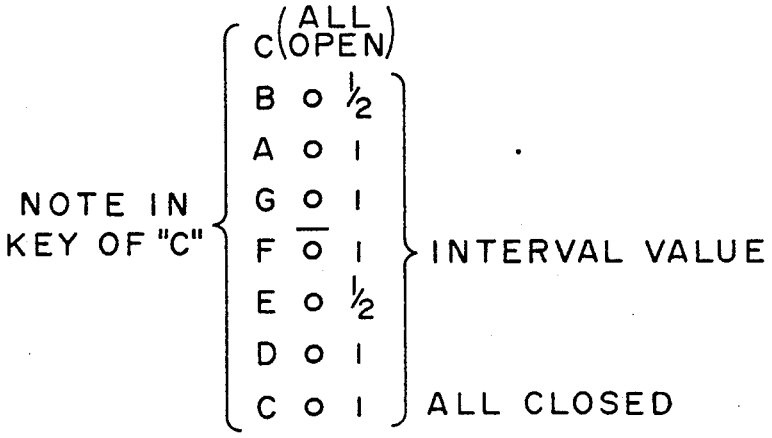
FIG. 3 provides additional information juxtaposed to a keyboard as in FIGS. 1 and 2.

The familiar "do-re-mi", or western scale is fundamental to our whole system of music and its harmonic structure. It is not comprised of entirely equal steps, but over a one octave range from tonic to tonic is made up of 5 whole-tone and two half-tone, or semitone, intervals which are arranged in a strict order. In FIG. 3, the intervals are placed alongside the simple flute keyboard of FIGS. 1 and 2 to illustrate the location of the whole-tone and half-tone notes.

Figure 4:
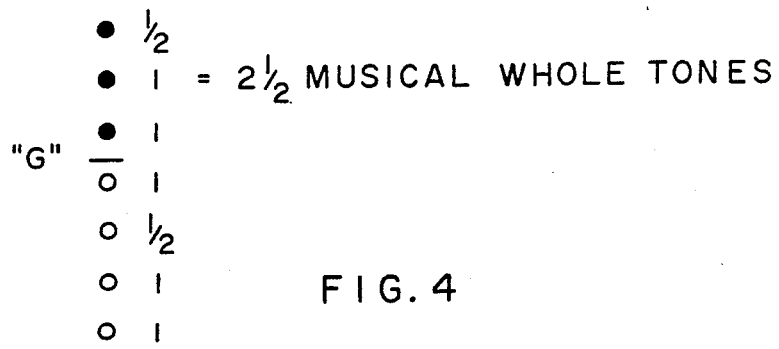
FIGS. 4 and 5 are modifications of FIG. 3.
Figure 5:
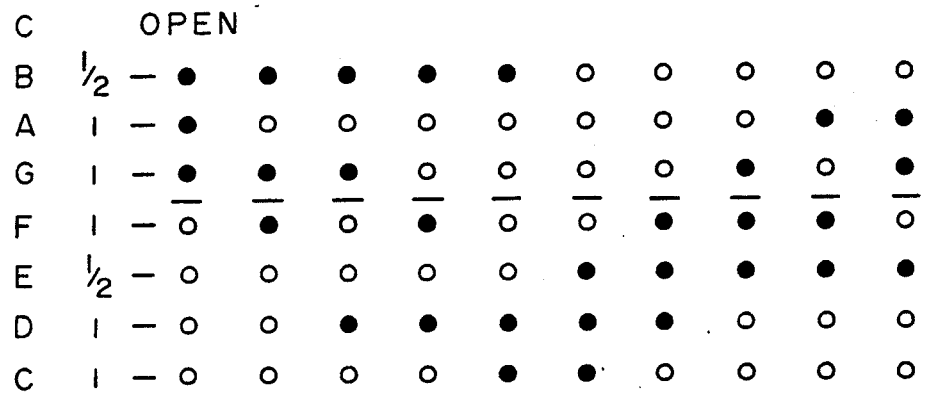

If we take the all-open pattern (top of scale) as the reference point or "zero" line, then it can be perceived that any notes achieved by closures can be thought of as "x" number of intervals below "zero". Musical intervals are equated to specific mathematical values. Any note from the top down can then be expressed as a sum of intervals. Thus, in our example, the note G would be played by closing the top three keys. See FIG. 4. G is then 2½ whole tones below open "C" in our example, as it is on the piano keyboard or on any other standard instrument. If we then redesign the programming in the decoding chip of FIG. 2 so that a specific mathematical value is assigned to each of the "holes"/keys/switches that corresponds to the value of that step on the major scale, we arrive at my interval-summing, or "algebraic", woodwind keyboard. In this system, the "G" of FIG. 4 can be played as shown and can also be played by any combination of keys which add up to 2½. Thus, in FIG. 5, all of the fingering combinations shown become legitimate ways of playing the same note "G". As can readily be seen, most of them are simply impossible for the standard woodwinds. Similarly, all other notes which may be calculated and arrived at by the same simple math. "F", for example, would be a sum of 3½. Any combination that adds up to 3½ will play an "F". Thus, the key to this keyboard system is Equal Sums=Equal Intervals.

While an extraordinary number of alternative fingerings is afforded, the player needn't memorize them by rote. He can rely upon the familiar up/down system of old until the nee arises in some especially tricky passage for a strange alternative, then reason it out.

Figure 9:
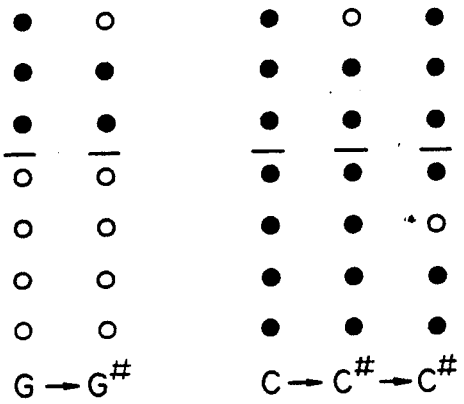
FIG. 9 is a modification of FIG. 3.

It can be fairly said that a goodly number of these alternative fingerings would be so strange and possibly awkward as to never be used, but there are some less obvious values to compensate:

(1) The simple seven bit system shown is automatically and inherently fully chromatic, i.e. able to play all the twelve semitones and not just the "white notes", as it were, with minimum of hardware. Chromatics are achieved by playing the note below and lifting the finger of one or the other of the ½ interval keys. This is illustrated with one example of G# and two examples for C# in FIG. 9.

(2) No strange performance glitches arise from default outputs due to unprogrammed input patterns from accidental near-misses or unintentionally hit keys on the part of the player. If what would have been an unprogrammed pattern occurs—a key is missed and its neighbor struck by mistake, for example—this keyboard will behave more naturally, more like a standard horn. It will play something *close* to the intent, just as a saxophone would, rather than leaping to the open "C" default, possibly an octave away. It will still be a mistake, but the result would be the kind of result the musician would expect, making the playing of it more normal and comfortable to the accomplished player.

(3) While many of the new alternative fingerings would seem very strange to the conventional player of long established habits at first, one by one, a lot of them become highly useful. And this inventor is intrigued by the possibilities to the neophyte, the unfettered new mind of the beginner who may not have played the conventional woodwinds.

With this keyboard, the natural logic of the old flute keyboard of the millennia is truly augmented and enhanced beyond any of its previous advances. It is, for the first time, possible to play it from the top down, the bottom up, or from the inside out. And, while the old-timer may get a moderate benefit in terms of heretofore impossible trills and so on, the human mind has always proven a plastic and amazing thing. This inventor awaits that fresh, unbiased "child"—unfettered by convention—who is sure to come along and find new ground here and slow us things that we have never seen—or heard—before.

II. Augmentations and Variations

The simple 7-bit keyboard thus described is my system in its purest and most symmetrical form. From this base, it can be augmented and modified to accommodate desired ends, such as to make it more familiar and emulative of the standard woodwinds to which the accomplished professional is accustomed.

Thus, range should extend a little beyond one octave to make transitions between registers easier and a bit less frequent. Also, the standard woodwinds—flutes, clarinets, oboes, saxophones, etc., all have base resisters (one full coverage of the keyboard before octave keys are depressed) in excess of an octave. A range of 16 semitones, though arbitrary, is an attractive choice for two reasons:

(1) The standard saxophone low register covers 16 semitones from open C# to low B-flat. The saxophone has the greatest playership of all the woodwinds.

(2) The quantity "16" fits in beautifully with digital electronics and is the kind of number computers and microprocessors deal with elegantly.

Additional keys can be added to expand range and provide familiarity for conventional players. Some keys may be redundant, i.e. wired in parallel and positioned to emulate familiar side keys that old habits gained on conventional instruments demand. As a saxophonist, this inventor very much missed the right hand A# key, mid G# key and low # key and included them as redundants to a "sharp key" function, i.e., a special function to remove or subtract a ½ tone value from the total sum, thereby "sharping" or raising by ½ tone the pitch that would result were not a sharp being depressed. Being redundant, such keys do not sum; i.e., pressing more than one at a time has no further effect. These are elected and placed for convenience.

Figure 6:
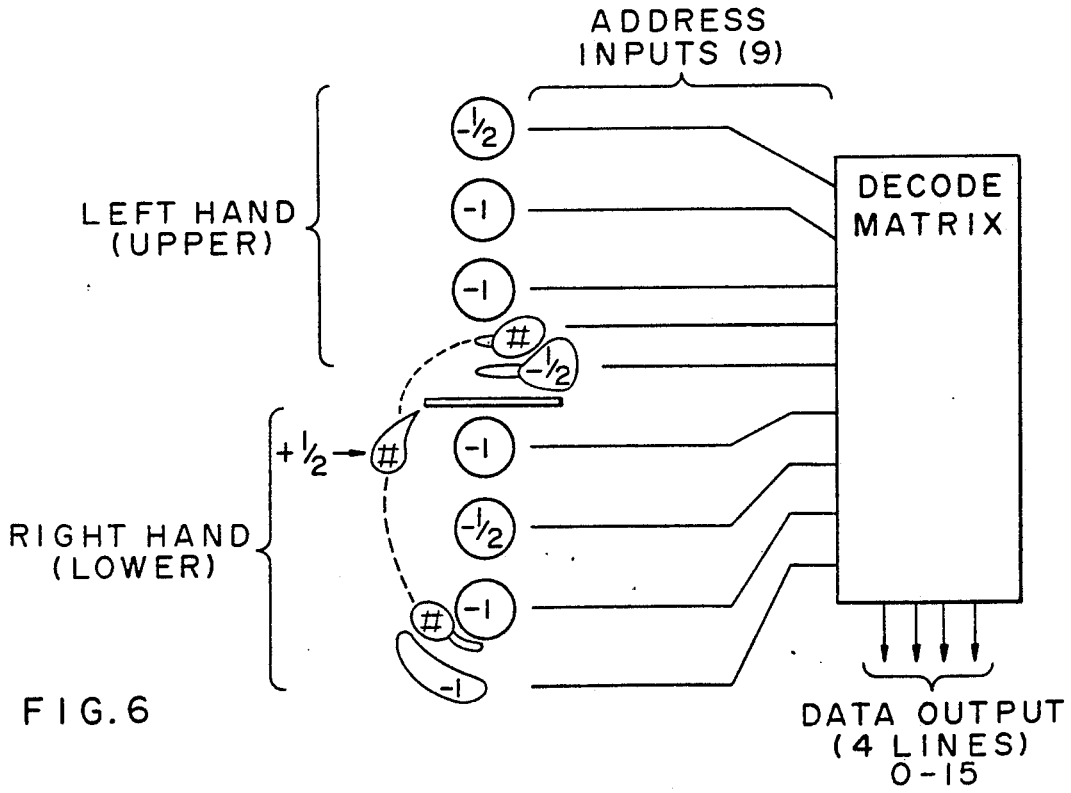
FIG. 6 is a modification of FIG. 2.

FIG. 6 illustrates an adequately enhanced version of the keyboard for professional use. The number of active address lines is increased from 7 to 9. The "sharp" key function has been incorporated. The dotted line indicates that these sharp keys are redundant, i.e. all paralleled on the same address line. Output data lines remain at 4 and thus there are 512 fingering patterns available to play 16 different intervals. All possibilities are programmed according to my interval summing scheme with but one irregularity—the lowest tone, or 16th semitone. Corresponding to the low "B-flat" of the standard saxophone, all keys are depressed. In this singular case, the "sharp" key is programmed to reverse its function, i.e. to add a ½ interval rather than subtracting one.

III. Further Irregularities

Figure 7:
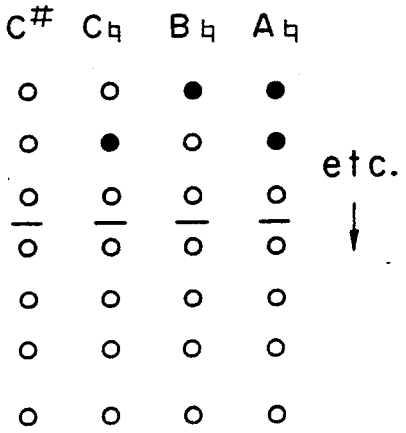
FIG. 7 is a modification of FIG. 3.

The summing keyboard thus described plays the ascending and descending scale in regular, straight order and can thus be program-ordered in a fully regular manner. This closely emulates some of the existing woodwinds, such as the low register of the Boehm-system clarinet, which plays an "F" scale by that straightforward pattern. Other members of the woodwind class have not evolved in strict adherence to this pattern, however. Thus, as illustrated in FIG. 7, the saxophone, for example, plays C# in open position and C-natural must be played by closing the pad beneath the middle finger of the upper (left) hand,. Then, from B-natural on down, the order is regular according to the straightforward pattern. There is no technical reason why the pattern programming could not use the open C# reference, but the key C# is seldom encountered by the everyday musician. An entire keyboard summing system based upon this referent would be inordinately difficult for the player to work with mentally. And, since the saxophone is more widely played than any other woodwind, it will be desirable to make some keyboards which accommodate its most pronounced irregularities; i.e., to use my basic summing system with selected irregularities to assist the player according to his accustomed instrument.

Digital EPROM chips and other digital hardware are now commonly available in such size and complexity to include more than one fingering system within a single instrument. A simple switching arrangement connected to an additional input address line or two would enable the player to choose, let us say, the clarinet or saxophone fingering systems at will, for example, Thus, the player of such new electronic instrument could use the fully regular "clarinet" system to get the idea of a summing keyboard and then switch over to the irregular system of his choice for comfort in performance. Players of both instruments could use both for practice, and so on. This capability within a single instrument is to the best of my knowledge unprecedented.

IV. Octave Keys

The summing woodwind keyboard so far described has covered the operation of a single "register", i.e., the musical range playable over a single course of the available keys—one octave to slightly in excess of one octave. Most woodwinds, even primitive flutes, can play at least two registers, often more: that is, the same keyboard is played over again in a higher pitch to extend the total range. Clarinets and saxes provide one "register" or "octave" key each. Flutes can accomplish it with breath and embouchure control. However done, most horns have about a three-octave range (more or less). To exceed this range, the player must switch to a different horn.

In physical terms, an octave is simply a doubling (up) or halving (down) of frequency. This is easy to accomplish with electronics by a considerable number of known-art methods and the technical aspects need not be dealt with here. What is important from the player's point of view is that the use of the single octave key on common horns is one of the most trying aspects of learning to play. To do this smoothly requires a lot practice. Electronics makes it entirely feasible to include as many octave keys as would exceed the range of written and even audible music—a temptation to which the beginning designer-engineer can easily succumb. (This inventor not excepted). Early prototypes of my own includes as many as 8 octave keys, which proved all but unmanageable. Decisions about the number of octave keys to include is, therefore, simply discretionary, but ought to be made with the poor player in mind. My own experience suggests a maximum of four, coupled with a device or method to shift that entire range up or down by octave steps. Common music tends to occur within the range of octaves 2 thru 7 of the 88 key piano keyboard. Beyond this, it is pretty much special effects and coloration.

Figure 8:
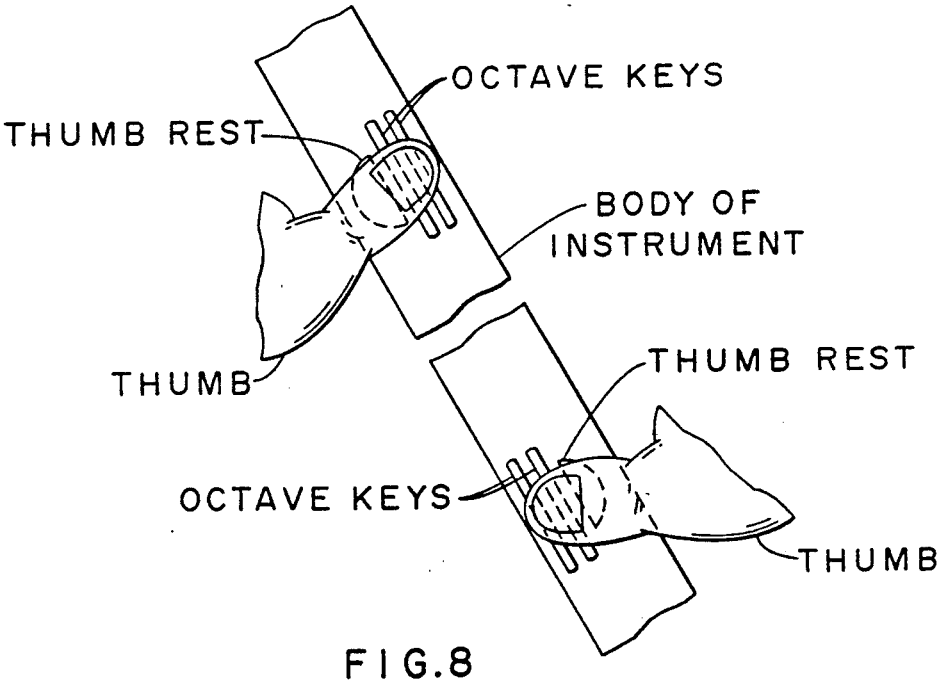
FIG. 8 shows fingering details of an instrument bearing a keyboard according to the invention.

The most manageable of multiple octave keys has thus far proven to be another summing system. In this system, no particular key is assigned to any specific octave. Rather, pressing any single key will raise the range one octave, any two keys two octaves, and so on. The primary reason this is so is that octave keys are traditionally placed to be operated by the left hand or upper thumb. Since thumbs also serve to support and balance the body of most horns, they are not only thus occupied, but clumsy in the bargain. This inventor uses both thumbs—distributing the octave keys two per each and positioning them intimately near the thumb rests, so that a thumb rolls onto first one key and continues further in the same motion to additionally press the second. See FIG. 8. Thus, a limited, accumulative rolling motion can be used to ascend or descend the registers, and the summing pattern frees the player's mind from concern over avoiding one key in favor of another. The rolling motion of the thumb most closely approximates the same action on conventional horns.

V. Further Details

Examples of decoding chips this inventor has used are 1) a Signetics 82S131, which is a 512×4 bipolar PROM, and 2) a 2764 or 27C64 EPROM. Many other commercially available chips would do as well.

Those skilled in the art are able to use the output from the keyboard of the invention to create the desired tones. For example, the 4-bit output may be used to control a multiplexer chip to select a desired signal from one of 16 different input lines to the multiplex chip, and the selected ones of 16 activates emission of the appropriate pitch unique to it. Further electronic processing can furnish modulation and timbre. Appropriate electronics to accomplish this is well within the skill of the electronics arts and may involve use of a top octave chip and appropriate dividers. A 4-bit output may also be converted to MIDI language to drive an existing synthesizer or to furnish real-time input to a microprocessor system as desired. And, the 7, 8, or 9 bits from the keyboard may bypass the use of a decoding chip and input to a microprocessor directly, to be made lucid through appropriate software.

The above are suggested as some of the practical means by which the interval summing system may be implemented. It is the organization of the keyboard(s) herein described that counts, not the electronics, for other and entirely different functions can be embodied in the identical set(s) if electronic hardware.

Further illustrative of the invention is the following Appendix I, which shows an example of a 7 bit input embodiment of the invention. Eight, nine, ten, or even more bits can electively be employed by following the principles as presented above.

Appendix I filed with the application

What is claimed is:

1. A keyboard comprising a plurality of keys, N in number, and decoding means, each key sending a signal corresponding to binary 1 or 0, or vice versa, to an input of the decoding means, depending on whether the key has been activated or not, the number of unique outputs of the decoding means being a number X which is less than the number of unique binary combinations of the keys, $2^N$, the X unique outputs being caused by a basic X unique binary combinations of the keys, and the remainder, $2^N-X$, of the binary combinations of the keys causing ore than one unique output, the decoding means assigning outputs to inputs on the basis of mathematical values associated with the keys.

2. An electronic musical keyboard comprising a plurality of keys, N in number, and decoding means, wherein said keys and decoding means interact to behave in playing action to resemble the playing of simple flutes and other woodwinds, each key delivering a status signal corresponding to a binary 1 or 0, or vice versa, depending on whether the key has been depressed or not, and in which decoding means provision has been made so that all possible combinations of key depressions and non-depressions and, therefore, all possible fingering patterns are valid and will serve to select one or another of the notes within the range or "register" prescribed by the number of keys "N", the decoding means assigning output to inputs on the basis of mathematical values associated with the keys.

3. An electronic musical keyboard comprising a set of keys and a decoding means, each key of said set being connected for delivering to the decoding means a status signal corresponding to a binary 1 or 0, or vice versa, depending on whether the key has been depressed or not, each of the keys of the set being assigned in the decoding means a mathematically weighted value corresponding to either a whole or half-tone musical interval, positive or negative sign, on the western tempered major musical scale, and by which assignment there may thus be up to four different types of keys: whole or half-tone, positive or negative sign, and in which there may be as few or many of each type of key as elected to effect a particular complexity of design, and which keys when pressed in plurality will act to sum in algebraic fashion according to the combined signed and weighted values of the keys depressed, the decoding means always having the same output for any given sum, no matter which keys were pressed to combine to provide the given sum.

4. An electronic musical keyboard fashioned generally after that of the woodwinds in that it provides for finger patterns corresponding to variation of length of a column of air but is supplemented in that it accepts as valid all additional finger patterns, said keyboard being comprised of a plurality of keys and a decoding means, each key being connected for delivering to the input of the decoding means its status as being either depressed or undepressed, according to the particular finger pattern being applied, and in which decoding means provision has also been made so that all possible binary combinations of key statuses will be recognized by the decoding means as valid input codes and be thereupon translated into output codes which will cause subsequent apparatus to create or choose the desired note, there being but a single not for each output code and but one output code at a time, in which keyboard the number of valid input codes is greater than the number of output codes, the decoding means assigning outputs to inputs on the basis of mathematical values associated with the keys.

5. An electronic musical keyboard comprising a plurality of keys and a decoding means, each key being connected for delivering to the decoding means a status signal corresponding to a binary 1 or 0, or vice versa, depending on whether the key has been depressed or not, the decoding means converting the combined status signals, as key depression patterns forming binary numbers, to provide a set of different outputs for playing different notes, there being only one output, for playing one note, for each binary number, the number of binary numbers formable by the keys being greater than the number of different outputs in said set, in which decoding means provision has also been made so that all possible fingering patterns cause outputs within said set, a plurality of the outputs in said set being caused by more than one key depression pattern, the decoding means assigning outputs to inputs on the basis of mathematical values associated with the keys.

6. A keyboard as claimed in claim 5, in which each of the keys has been assigned in the decoding means a specific mathematically weighted value corresponding to either a whole or half-tone musical interval, positive or negative sign, on a western tempered major musical scale, and by which arrangement there may thus be up to four different types of keys: whole or half-tone, positive or negative sign, and in which there may be as few or many of each type of key as elected to effect a particular complexity of design, and which keys when pressed in plurality of will act to sum in algebraic fashion according to the combined signed and weighted values of the keys depressed, the decoding means always having the same output for any given sum, no matter which keys were pressed to combine to provide the given sum.

7. A keyboard as claimed in claim 6 in which the "open", or no-keys-depressed, fingering pattern is regarded as a "zero" reference from which a descending scale is played by progressively closing more and more keys which sum according to the familiar straight descending pattern common to the woodwind family, to comprise a basic set of fingering patterns, but which also by virtue of the summing feature can play the same scale by fingering patterns closing keys from the bottom up and in numerous other ways not possible on instruments using resonating air columns of different lengths.

8. A keyboard as claimed in claim 5, the outputs extending over a range, in which keyboard an output located centrally in the range, relative to an output located toward the outside of the range, is caused by a greater number of fingering patterns as compared to the number of fingering patterns which cause said output located toward the outside of the range, the keyboard thus having a plurality of alternate fingering patterns for most outputs of the decoding means, and larger numbers of fingering patterns for some outputs, most of which fingering patterns are not usable on keyboards of instruments using resonating air columns of different lengths.

9. A keyboard as claimed in claim 5, having a basic set of fingering patterns, said basic set being defined as a set of fingering patterns resembling fingering patterns as found on resonating-air-column-based woodwinds, said keyboard having outputs from fingering patterns beyond those of the basic set, in which the effect of the fingering patterns beyond the basic set obey the formula/principle:

"equal sums = equal intervals38 with regard to a reference "zero", wherein said formula/principle is to be understood in that each key always either 1 or ½, positive or negative, to a sum, depending on whether the key is depressed or undepressed, the sum determining the number of an interval on a musical scale.

10. A keyboard as claimed in claim 6, comprising 7 keys, the decoding means having at least 13 different outputs corresponding to a basis set of 13 different fingering patterns of the 7 keys, for providing control over a register of one fully chromatic octave of 13 semitones.

11. A keyboard as claimed in claim 10, comprised of more than seven keys, the decoding means having outputs for registers spanning more than one octave.

12. A keyboard as claimed in claim 11, in which an irregularity is imposed upon the fingering pattern system for emulating a corresponding irregularity in the fingering pattern system of an instrument using resonating air columns of different lengths or for accomplishing some other purpose of functional design while otherwise retaining the basic summing principle, said irregularity thus forming an exception to the summing principle otherwise used in the keyboard.

13. A keyboard as claimed in claim 12, a plurality of irregularities underlying the same set of keys, further comprising means for switching to selected irregularities, whereby a player may select at the election of the player one or more fingering pattern variations.

14. A keyboard as claimed in claim 6, having at least one redundant key for giving a choice of locations from which a given key value can be implemented, a redundant key being redundant to a matching key, a redundant key being redundant in the sense that its value does not sum when its matching key has already been pressed.

15. A keyboard as claimed in claim 6, having register keys which sum for changing registers as a function of the number of register keys pressed.

* * * * *